United States Patent [19]

Jaquez

[11] Patent Number: 4,807,881

[45] Date of Patent: Feb. 28, 1989

[54] RANDOM CHARACTER SELECTOR

[76] Inventor: Ramiro Jaquez, 1692 Burley Dr., Milpitas, Calif. 95035

[21] Appl. No.: 40,992

[22] Filed: Apr. 20, 1987

[51] Int. Cl.[4] ..... A63F 7/04

[52] U.S. Cl. ..... 273/144 B

[58] Field of Search ..... 273/144 B, 145 C, 138 R, 273/142 E

[56] References Cited

U.S. PATENT DOCUMENTS

| | | | |
|---|---|---|---|
| 3,204,345 | 9/1965 | Buckner | 273/145 C X |
| 4,465,278 | 8/1984 | Messina et al. | 273/144 B |
| 4,498,671 | 2/1985 | Kostow | 273/144 B |

FOREIGN PATENT DOCUMENTS

| | | | |
|---|---|---|---|
| 1480344 | 4/1967 | France | 273/144 B |
| 2455777 | 1/1981 | France | 273/144 B |
| 1418690 | 12/1975 | United Kingdom | 273/138 R |

*Primary Examiner*—Paul E. Shapiro
*Attorney, Agent, or Firm*—John J. Leavitt

[57] ABSTRACT

Presented is a random alpha-numeric selector device useful for selecting combinations of random letter or random numbers or combinations of these for participating in lottery, lotto games, and/or Keno-type "match" games, and useful also for selecting combinations of random characters for participating in an alphabet teaching session. Structurally, a rectangular box having opposite transparent sides is provided with a matrix plate enclosed within the box with the matrix plate provided with recesses formed to accommodate spherical balls that may be agitated within the box and which randomly settle in the recesses. One side of the matrix may contain 80 recesses, for instance, with 7 or 8 balls so that the device may be utilized for randomly selecting numbers to be played in the game of keno, or randomly selecting letters of the alphabet to assist elemenary school students in identifying the letters of the alphabet. Alternatively, the opposite side of the matrix, also provided with recesses, may contain only 49 recesses, and 6 balls so that the device may be utilized to randomly select six numbers for playing the game Lotto 6/49.

6 Claims, 1 Drawing Sheet

RANDOM CHARACTER SELECTOR

BACKGROUND OF THE INVENTION

1. Field of the Invention

This invention relates to random number or random letter or character selector devices, and particularly to such a device that may be carried in the pocket or on a key chain for ready accessiblity.

2. Description of the Prior Art

The prior art relating to this invention is believed to reside in Class 273, sub-classes 144 and 148.

A preliminary patentability search through this area of search, as indicated that the existence of the following U.S. Pat. Nos.:

3,237,949
4,497,486
4,545,578
4,498,671

Referring to the four patents in the order of their issuance, U.S. Pat. No. 3,237,949 relates to a device which comprises a small rectangular box within which there is a movable panel having a multiplicity of depressions on the top surface and having a central post extending through the top panel of the box. Marked in each of the indentations on the plate are the numbers and symbols that you would normally find on a deck of cards. The device is utilized for randomly selecting a simulated card hand by depressing the post so as to release the balls within the space between the top panel and the recessed panel. When the case has been shaken so as to agitate the balls, the post is released and the balls will then be held captive between the top plate and the recess plate, thus retaining for at least a while the positions of the randomly placed balls, their positions indicating the character of the "hand" randomly selected.

U.S. Pat. No. 4,497,486 is a device designed specifically for selecting numbers randomly. Structurally the device comprises a base on which is mounted a sheet having a plurality of regularly spaced protuberances that form depressions therebetween, and a transparent cover is provided to enclose the multiplicity of hemispherically shaped protuberances. Enclosed within the transparent case are a plurality of spherical balls that come to rest in the recesses formed between four adjacent protuberances. When the device is shaken, the balls are agitated and randomly come to rest in the recesses, each of which is identified by a different number.

U.S. Pat. No. 4,498,671 relates to a lotto dice device used for selecting random numbers to be inserted in a lotto card. The structure of this device comprises a cube all six sides of which are apertured, with a group of balls corresponding in number to the number of a lotto card grid being enclosed within the cube. When the cube is agitated, the balls come to rest randomly in the aperture and the cube is then superimposed over a lotto grid card to identify the numbers to be marked on the card.

U.S. Pat. No. 4,545,578 relates to a device for randomly selecting numbers particularly for use in playing a lotto game. This device provides a housing, hollow on the interior and provided with base members within the housing formed with recesses. One side of the housing, designated the top, is provided with numerals each of which is in registry with a complimentary recess within the housing. A group of balls are provided within the housing which may be agitated so that they will settle in randomly selected recesses. The recesses in which the balls come to rest, being correlated to the numerals in the top panel of the housing, determine the numbers to be marked on a lotto card.

It will thus be seen that the board concept of using a multiplicity of balls to rearrange themselves in depressions within a container is an old concept in the art. Nevertheless, the structures depicted by these various patents, while embodying a similar concept, are structurally different from each other and from the structure forming the subject matter of the instant invention.

Most of the devices that I am familiar with, including those forming the subject matter of the patents listed above, are formed from spatially manufactured components which thereby increases the cost of the devices. Experience has taught that many people have difficulty selecting random numbers for a lottery or lotto game, and use various systems for determining the numbers to be used in such games. One popular method that is used by many people is to use the ages of their children or of their parents or other relatives. Another method is to use the numbers on license plates, while a still further method is to select various positions on the form regardless of what the numbers are contained at those positions. In every case, the various methods require a decisional process that can frequently be time consuming and traumatic for the person attempting to select the numbers randomly. Accordingly, one of the objects of this invention is to provide a small-hand-held mechanical device which may easily be utilized to randomly select numbers for a lottery or lotto game.

Another object of the invention is the provision of a random character selector device which is relatively inexpensive, and assembled from readily available components without the need for special manufacturing procedures.

A still further object of the invention is the provision of a random character selector device that may be used on the one hand to choose a predetermined number of numbers in a lottery, and may also be used for chossing randomly the numbers to be used in a lotto game.

People frequently like to personalize items they carry in their pocket. Accordingly, another object of the invention is the provision of a random number selector device that is arranged so that personalized indicia may be visible through the transparent housing.

Another object of the invention is the provision of a random character selector device, either number, letter or both, that may be used as an alphabet training aid and/or a numeral recognition aid for students in the elementary school level.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the random character selected device of the invention comprises a transparent hollow box including a main container portion and a cover portion. The container portion includes a transparent bottom wall, while the top portion includes a transparent top wall. Disposed medianly between these two transparent walls are two transparent plates arranged back-to-back with the surfaces of the plates facing away from each other provided with a multiplicity of recesses. Disposed between the two back-to-back plates is a sheet of material on which are printed indicia correlated in position to the recesses formed in the associated transparent plate, and arranged so that the indicia are condensed and visible through the associated plate, and because of being condensed, made to appear "boldface" to the viewer. Filler means are provided within the housing adapted to occupy whatever hollow portion of the interior of the container and top of the container that is not occupied by the transparent recessed plate. Means are also provided associated with one corner of the case for attaching the case to a key ring. Additionally, one surface of each of the filler members within the housing is arranged to receive indicia adapted to personalize the random number selector device. When appropriate, or desired, the cover portion and container portion may be bonded to render their union water tight, thus providing for sufficient bouyancy in the device that it will float in water.

DESCRIPTION OF THE PREFERRED EMBODIMENT

Figure 1:
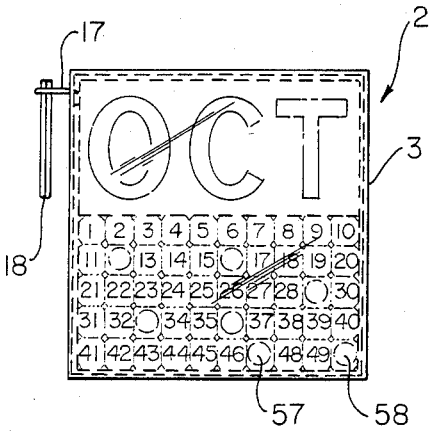
FIG. 1 is a bottom plan view of the random character selector device having exposed through the transparent bottom an alpha-numeric card useful in selecting random numbers for the game of Lotto 6/49.
Figure 2:
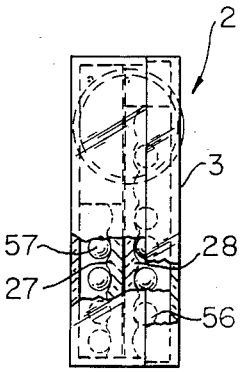
FIG. 2 is an elevational view, portions of the housing being broken away to reveal the underlying structure.
Figure 3:
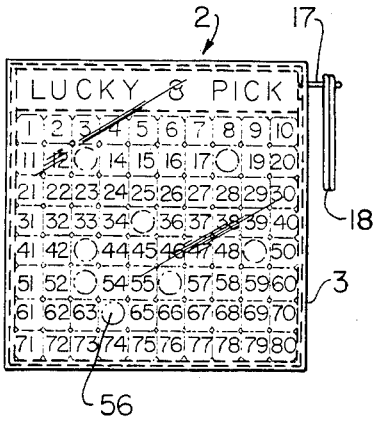
FIG. 3 is a top plan view illustrating a different alphanumeric card visible through a transparent recessed plate mounted within the transparent housing.
Figure 4:
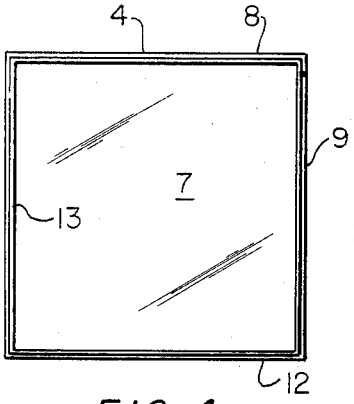
FIG. 4 is a plan view of the container portion of the device with the cover removed.
Figure 5:
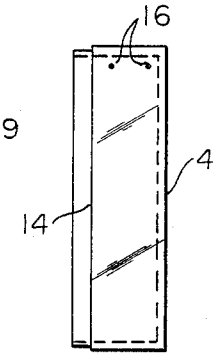
FIG. 5 is an end elevational view of the structure illustrated in FIG. 4.
Figure 7:
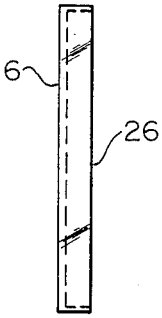
FIG. 7 is an end elevational view of the cover portion illustrated in FIG. 6.
Figure 6:
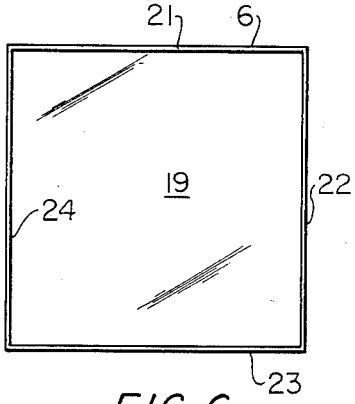
FIG. 6 is a bottom plan view of the transparent cover apart from the container portion.

In terms of greater detail, the random character selector device of the invention in its assembled form as illustrated in FIGS. 1, 2 and 3, is designated by the numeral 2, and comprises a two-part housing or container 3 including a base portion 4 (FIGS. 4 and 5), and a cover portion 6 (FIGS. 6 and 7). The base portion 4 of the housing 3 is provided with a transparent bottom wall 7, generally square or rectangular in its configuration, and having around its peripheral edge upstanding walls 8, 9, 12 and 13, the side walls being rabbetted adjacent their upper free ends remote from the base 7 to provide a peripheral shoulder 14 all around the base member as illustrated in FIGS. 4 and 5. Associated adjacent one of the corners of the base member are two vertically spaced apertures 16 through which extends a U-shaped fastener 17 (FIG. 1) to which fastener is removably attached a key ring 18.

The cover 6, as illustrated in FIGS. 6 and 7, includes a transparent top panel 19 surrounded about its peripheral edge by upstanding integral walls 21, 22, 23 and 24, the height of these walls and their thickness being proportioned to snugly slidably engage the upper rabbetted edge portion of the walls 8, 9, 12 and 13, the top edges 26 of the cover walls being adapted to rest snugly against the shoulder 14 of the base portion when the cover is placed on the base portion. These two members may be detachably engaged, as shown, or may be bonded with an appropriate adhesive to render the union water tight. In this alternative water tight embodiment, a sealant would also plug the apertures 16 (FIG. 5).

Figure 12:
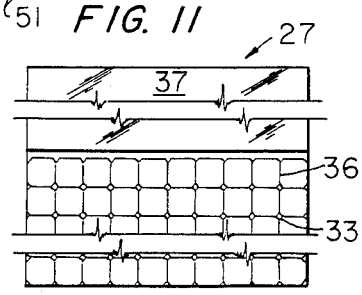
FIG. 12 is a plan view of the transparent recessed plate illustrated in FIG. 1, shown apart from the housing, and portions of the structure being broken away to reduce the size.

Mounted within the base portion 4 of the housing 3, is a pair of flat, transparent plates 27 and 28 (FIG. 2), the plates being mounted within the housing in a back-to-back relationship as illustrated. Referring to FIG. 12, the flat transparent plate 27 is provided with lateral edges that conform in size and configuration to the inner peripheral surfaces of the sides of the base member 4. Additionally, with reference to FIG. 13, the flat transparent plate 27 is provided along one edge with a thickened portion 27' as illustrated. The width of the thickened portion 27' is defined by one edge 29 of the plate and an opposite shoulder 31. As illustrated, this dimension of the thickened plate portion constitutes a definition or limitation on the remaining width of the flat transparent plate 27. It will of course be apparent that the thickened plate portion 27' could be more narrow, or wider, or formed by a flange (not shown) which would nevertheless provide the restrictive wall or shoulder 31 which defines one dimension of the remaining recessed portion of the transparent plate.

Figure 13:
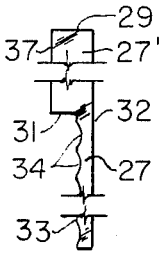
FIG. 13 is a right edge view of the transparent recessed plate illustrated in FIG. 12.
Figure 14:
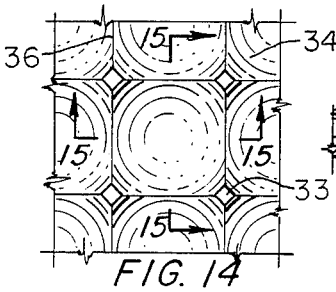
FIG. 14 is an enlarged fragmentary elevational view in plan illustrating the formation of recesses in the transparent recessed plates.
Figure 15:
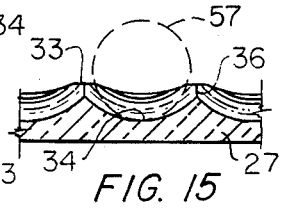
FIG. 15 is a fragmentary cross-sectional view taken in the plane indicated by the line 15–15 in FIG. 14.

As illustrated in FIG. 13, the generally flat transparent plate 27 is provided with a rear surface 32 that is relatively smooth and transparent, while the opposite surface 33 of the plate 27 is provided with a multiple series of juxtaposed semi-spherically formed concave recesses 34, each of the multiple semi-spherical recesses being separated from the next adjacent recess by an arcuate ridge 36 as illustrated. Because of this semi-spherical configuration of each of the recesses 34, each of the recesses functions as a concave lens adapted to condense the visual appearance of an object seen through the recess. Additionally, the flat surface 37 of the thickened plate portion 27' of the plate 27 may be utilized to support appropriate personalizing indicia such as the owner's name or the abbreviation of the month in which the owner was born. In the interest of clarity in the drawings, such pesonalized indicia is illustrated lightly. Alternatively, since the thickened wall portion 27' is transparent in the same way that the remainder of the flat transparent plate 27 is transparent, such personalizing indicia, appropriately printed on a thin sheet of material, such as paper or foil, may be disposed against the flat bottom surface 32 of the transparent plate in the area occupied by the thickened portion 27', thus making the personalized indicia visible through the transparent top panel 19 and the face 37 of the thickened plate portion 27'.

Figure 8:
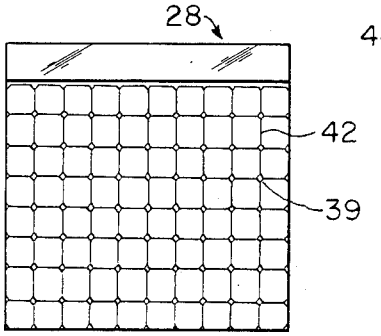
FIG. 8 is a plan view of the transparent recessed plate illustrated in FIG. 3 apart from the housing.
Figure 9:
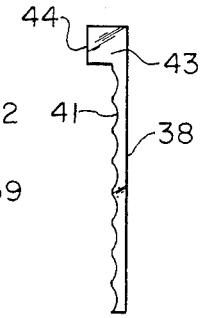
FIG. 9 is an edge view of the transparent recessed plate of FIG. 8.

Referring to FIGS. 8 and 9, the flat transparent plate 28 is in like manner provided with a smooth rear or bottom surface 38, the opposite surface 39 of which is provided with a multiplicity of series of semi-spherical concave recesses 41, each of the recesses being separated from adjacent recesses by the arcuate ridge 42. As with the recesses 34, the recesses 41 cooperate with the rear surface 38 to form a concave lens that has a condensing and boldfacing effect for anything that is viewed through the concave recess. Adjacent one edge, the plate 28 is thickened in a portion 43 having a flat transparent top face 44 as shown.

Figure 11:
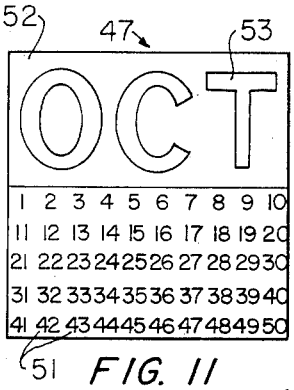
FIG. 11 is a plan view of the alpha-numeric card illustrated in FIG. 1, showing the indicia printed thereon, and shown apart from the housing.
Figure 10:
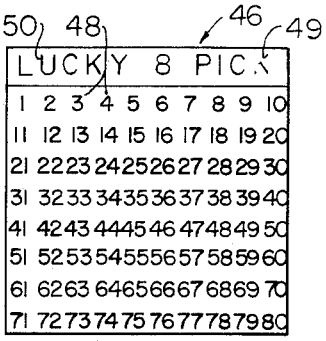
FIG. 10 is a plan view of the alpha-numeric card illustrated in FIG. 3, showing the indicia printed thereon, and shown apart from the housing.

Two additional component parts are the indicia cards 46 and 47 illustrated in plan in FIGS. 10 and 11, respectively. The indicia card 46 is adapted in transverse dimensions to coincide with the corresponding dimensions of the flat transparent plate 28, and comprises a thin sheet of paper or card stock on which are printed in multiple series corresponding to the multiple series of recesses formed in the plate 28, indicia 48 in the form of numbers increasing consecutively from "1" to "80", there being eight rows or series of ten numerals to a row. This numbering scheme of course corresponds to the numbering scheme of a game of chance popularly known as "Keno", in which the object of the game is to correctly "match" as many numbers as possible out of a group of twenty numbers randomly selected out of a larger group of eighty numbers. The card 46 is adapted to be placed next adjacent the smooth back surface 38 of the plate 28 so that the numbers on the card are next adjacent the surface 38 and correspond in position with the recesses 41 as illustrated in FIG. 3, so that the numerical indicia are clearly visible through the plate and condensed in size and boldfaced by the lens effect of the semi-spherical concave recesses 41. The portion 49 of the card not used for indicia 48 may carry personalized indicia 50, such as an appropriate trademark. It will of course be apparent that alpha-numeric indicia of various forms and combinations of forms could be substituted for the numbers illustrated, particularly where the device is to be used as a teaching aid for teaching the alphabet or numbers.

The indicia card 47 also corresponds in size to the flat transparent plate 27, and includes numerical indicia 51 in the form of five series of numbers arranged consecutively in parallel rows of ten numbers each for a total of fifty numbers as illustrated. The portion 52 of the card not utilized for the display of numerical indicia may be used for the impression or printing of personalized indica 53, such as the owner's name or the month of the owner's birth, or any other selected indicia. As with the indicia card 46, characters other than numbers may be substituted where appropriate.

It will thus be seen that when the numerical cards 46 and 47 are placed next adjacent and in contiguous relation to the flat transparent plates 28 and 27, respectively, with the numeral side of the cards facing the back sides of the transparent plates, the numbers are oriented so that each number may be seen through one of the recesses formed in the opposite surface of the associated flat transparent plate. As indicated above, the recess in the flat transparent plate functions as a concave lens to condense and emphasize the number as seen through the recess.

As illustrated in FIG. 2, the two flat transparent plates 27 and 28 are mounted in the container or housing in back-to-back relationship with the alpha-numeric cards disposed between the two flat transparent plates. Thus, as viewed in FIG. 3, the numerical indicia 48 are visible through the transparent top 19 of the cover, while the numerical indica 51 are visible through the transparent bottom 7 of the housing.

Because of the thickness of the transparent plate portions 27' (FIG. 13) and 43 (FIG. 9), the two back-to-back plates assembled with the two alpha-numeric cards 46 and 47 disposed therebetween, occupy a generally median position within the housing with respect to its interior depth. Thus, the portion of the interior of the housing subtended by the recessed portion of the plate 38 provides clearance between the recessed surface of the plate, including the areas 39 and the arcuate ridges 42, and the underside of the tranparent top 19 of the cover 3. This clearance is sufficient for the free movement of a number of spherical balls 56, here eight in number, when the housing is shaken from side-to-side. In this way, the balls 56 are agitated, moving in directions largely determined by the interaction of the spherical surfaces of the balls with the surfaces 39 and the arcuate ridges 42. When shaking of the housing is discontinued, the balls will settle randomly in the recesses 41, thus indicating for the user the randomly selected numbers that may be used to mark an "Eight Spot" Keno ticket.

In like manner, the portion of the interior of the housing next adjacent the transparent bottom and subtended by the recessed portion of the flat transparent plate 27 provides clearance for the free movement of a number of spherical balls 57, constituting a second set thereof and distinct from the balls 56 associated with the plate 38. The set of balls 57 are six in number, but may be of another number, appropriate to the game being played. As with the set of balls 56, when the housing is shaken, the balls 57 are agitated, move in various directions, and when the shaking stops, the balls come to rest randomly in the associated recesses 34. It should be noted that while the card 47 is provided with fifty numerals, in a game such as that played in California, called Lotto 6/49, only forty-nine numbers are used instead of fifty. Accordingly, the spot on the card 47 that carries the number "50" is blanked off, conveniently, with an extra ball 58 that is adhesively secured to the card so that it does not move when the housing is shaken. Obviously, other means for blanking off this number may be used, or in an appropriate situation, the number may be omitted entirely. Alternatively, other number series may be used, dependent upon the types of lotto games used in other States.

Having thus described the invention, what is believed to be new and novel and sought to be protected by Letters Patent of the United States is as follows.

I claim:

1. A random character selector device, comprising:

(a) a housing having at least one transparent wall;

(b) at least one flat transparent plate mounted concave recesses on one surface separated from each other by an arcuate ridge and being relatively smooth on its opposite surface;

(c) an indicia card within the housing having indicia on one side thereof arranged in a pattern corresponding to the pattern of said semi-spherical concave recesses in said at least one flat transparent plate and juxtaposed thereto whereby the indicia on the card are visible between said arcuate ridges through said flat transparent plate and through said transparent wall of said housing; and (d) a multiplicity of separate spherical balls within the housing associated with the recessed surface of said flat transparent plate and freely movable about within the housing among the concave recesses when the housing is shaken whereby when the shaking of the housing is stopped said balls settle randomly in said semi-spherical concave recesses between associated arcuate ridges to thereby indicate randomly selected indicia.

2. The combination according to claim 1, in which a second flat transparent plate is mounted within the housing having a multiplicity of semi-spherical concave recesses on one surface separated from each other by an arcuate ridge and being relatively smooth on its opposite surface, and a second indicia card is provided mounted within the housing and having indicia on one side thereof arranged in a pattern corresponding to the pattern of said semi-spherical concave recesses in said second flat transparent plate, said first mentioned indicia card and said second indicia card being mounted between said first mentioned flat transparent plate and said second flat transparent plate whereby the indicia of each card are visible between said arcutae ridges through the associated flat transparent plate, and a second set of spherical balls within the housing associated with said second flat transparent plate and freely movable about within the housing among the concave recesses when the housing is shaken whereby when the shaking is stopped said second set of balls settle randomly in said associated semi-spherical concave recesses between associated arcuate ridges.

3. The combination according to claim 1, in which means are provided mounted on said housing for suspending the housing from a key ring.

4. The combination according to claim 1, in which said at least one flat transparent plate provides a thin plate portion in which said recesses are formed, and a relatively thicker transparent portion bordering on one side of said thin plate portion and providing a wall next adjacent said recessed thin plate portion whereby when said balls are agitated by shaking of the housing the balls are limited in their movement in one direction by said wall.

5. The combination according to claim 4, in which said second flat transparent plate provides a thin plate portion in which said concave recesses are formed, and a relatively thicker transparent portion bordering on one side of said thin plate portion and providing a wall next adjacent said recessed thin plate portion, said thick and thin plate portions of the two flat transparent plates being juxtaposed.

6. The combination according to claim 2, in which means are provided mounted on said housing for suspending the housing from a key ring.

* * * * *